US007534198B1

(12) United States Patent
Strong

(10) Patent No.: US 7,534,198 B1
(45) Date of Patent: May 19, 2009

(54) DUMBBELL SUPPORTING APPARATUS

(76) Inventor: Fredric D. Strong, 803 W. Freddy Gonzales Dr., Edinbu, TX (US) 78539

( * ) Notice: Subject to any disclaimer, the term of this patent is extended or adjusted under 35 U.S.C. 154(b) by 0 days.

(21) Appl. No.: 12/042,077

(22) Filed: Mar. 4, 2008

(51) Int. Cl.
*A63B 21/078* (2006.01)
*A63B 21/072* (2006.01)

(52) U.S. Cl. ..... 482/94; 482/108

(58) Field of Classification Search ..... 482/17, 482/67, 89, 90, 92–94, 104, 106–108, 110, 482/121, 129, 130, 132, 148; D21/681, 686; 211/22, 85.7, 193; 248/125.3, 125.8, 163.2
See application file for complete search history.

(56) References Cited

U.S. PATENT DOCUMENTS

| | | | | | |
|---|---|---|---|---|---|
| 615,995 | A | * | 12/1898 | Leonard | 211/22 |
| 2,156,862 | A | * | 5/1939 | Maugard | 248/123.2 |
| 3,373,993 | A | * | 3/1968 | Oja et al. | 607/33 |
| 3,507,402 | A | * | 4/1970 | Barbee | 211/204 |
| 4,188,966 | A | * | 2/1980 | Palmer et al. | 135/67 |
| 4,205,838 | A | * | 6/1980 | McIntosh | 482/106 |
| 4,552,270 | A | * | 11/1985 | Lentz et al. | 211/17 |
| 4,666,150 | A | * | 5/1987 | Segrist et al. | 482/104 |
| 4,773,642 | A | * | 9/1988 | Cruz | 482/104 |
| 5,466,204 | A | * | 11/1995 | Nearing | 482/102 |
| 5,472,397 | A | * | 12/1995 | Ammoscato et al. | 482/104 |
| 5,810,697 | A | * | 9/1998 | Joiner | 482/68 |
| 5,924,964 | A | | 7/1999 | Hayden | |
| 5,954,619 | A | | 9/1999 | Petrone | |
| 5,971,898 | A | * | 10/1999 | Schoolfield | 482/104 |
| D425,152 | S | * | 5/2000 | Ceppo | D21/686 |
| 6,086,520 | A | | 7/2000 | Rodriquez | |
| D441,813 | S | | 5/2001 | Ceppo | |
| 6,348,028 | B1 | * | 2/2002 | Cragg | 482/148 |
| 6,715,728 | B2 | | 4/2004 | Nielsen | |
| D495,383 | S | * | 8/2004 | Ceppo | D21/686 |
| 6,843,380 | B1 | * | 1/2005 | Fickett | 211/22 |
| 7,001,314 | B1 | | 2/2006 | Hummer, Jr. | |
| 7,029,425 | B2 | * | 4/2006 | Krull | 482/94 |
| 7,112,163 | B2 | * | 9/2006 | Krull | 482/104 |
| 7,156,782 | B1 | | 1/2007 | Krull | |
| 7,156,783 | B2 | | 1/2007 | Chen | |
| 7,285,077 | B1 | * | 10/2007 | Marx | 482/104 |
| 2004/0050807 | A1 | * | 3/2004 | Cheng | 211/17 |
| 2007/0049472 | A1 | * | 3/2007 | Hummer | 482/104 |

FOREIGN PATENT DOCUMENTS

| | | | | |
|---|---|---|---|---|
| CA | 2232285 | A | * | 9/1998 |
| DE | 29806759 | U1 | * | 7/1998 |
| WO | WO 9939778 | A1 | * | 8/1999 |

* cited by examiner

*Primary Examiner*—Loan H Thanh
*Assistant Examiner*—Victor K Hwang
(74) *Attorney, Agent, or Firm*—Crossley Patent Law; Mark A. Crossley

(57) ABSTRACT

A dumbbell supporting apparatus having a matching pair of stanchions and a matching pair of stands, each stand for optional combined use with the castered stanchions. The adjustable height cradle positions of each stanchion position a removably placed dumbbell at least 25 inches outwardly from the upright of each stanchion, thereby providing clearance for exercise. Each stand can store weights, and each stand is selectively and elastomerically hooked to a stanchion, providing for stanchion retreat from an exerciser with the dumbbell lifted from the stanchion.

12 Claims, 4 Drawing Sheets

DUMBBELL SUPPORTING APPARATUS

BACKGROUND OF THE INVENTION

Various devices exist for storing dumbbells when not in use. Some provide means for storing a dumbbell in a position ready for use, or proximally so. At least one such device provides a complex means for partial storage rack retreat, once a dumbbell is lifted. The recent offering of such devices fulfills a need for dumbbell support wherein a user assumes a position at least proximal to usage, then lifts the dumbbell or dumbbells for use. The need for such devices stems from the fact that, especially as dumbbells increase in weight, a user is challenged in assuming a lifting position with dumbbell/s in hand/s. For example, a user might be in a position for butterfly, press, decline press, or incline press, and have a need for the dumbbells to be proximal to the initial lifting position. Therefore, such devices are provided in order to negate the need for a spotter, thereby allowing a lifter to perform exercises alone.

At least one device as noted above provides for fit to an existing bench, an approach which not only limits the device's use to an accommodating bench, but one which also limits the use to the functions of the bench. Further, the dumbbells are not well positioned with such devices. And, the use of only one dumbbell, especially a heavy one, can result in insecurity of the device and weight. Further, exercises are often performed with dumbbells in tandem, that is, with a dumbbell in each hand, each hand performing a mirror image exercise of the other. A beginning position of each dumbbell should ideally be extremely close to if not exactly in the beginning position of the exercise. Further, once the exercise is begun, the ideal dumbbell support should substantially be out of the way of exercise performance, a fact which limits existing devices to very few. The ideal dumbbell support should provide for support of one or two dumbbells, each independently of the other, in multiple user desired positions, then provide for optional selective retreat of the support once exercise is begun. In addition, the ideal device should be basic in order to provide for unfailing use and a user friendly profile that needs no learning curve. The ideal device should also provide for other weight facility functions, while being inexpensive to produce and sell. Additionally, the ideal device should provide for support of relatively heavy dumbbells, without fear of failure or toppling. The present apparatus fulfills these needs.

FIELD OF THE INVENTION

The dumbbell supporting apparatus relates to devices for holding dumbbells and more especially to a dumbbell supporting apparatus which supports a dumbbell in a ready-to-grasp position, and further provides for selective unassisted retreat of the support when the dumbbell is lifted.

SUMMARY OF THE INVENTION

The general purpose of the dumbbell supporting apparatus, described subsequently in greater detail, is to provide a dumbbell supporting apparatus which has many novel features that result in an improved dumbbell supporting apparatus which is not anticipated, rendered obvious, suggested, or even implied by prior art, either alone or in combination thereof.

To attain this, the dumbbell supporting apparatus is provided in duplicate, with two pairs of components. Each pair comprises a stanchion for holding a dumbbell at an adjustable height and a stand for selective use in affecting a retreat of the stanchion once the dumbbell is lifted. Further, as typical weight facility space is always challenged, the stand performs further function as a storage rack for weights. Each stand may have dumbbells placed on it and may also have the typically used weight room weights stacked over the stand vertical, as such weights are provided with holes in the centers. Additionally, the stanchions may be used without the stands, as desired.

The positioning of a stanchion supported dumbbell provides that one leg of the x-brace support of each stanchion is directly below the dumbbell's mass. Additionally, the dumbbell's mass is very near the center of the x-brace support where the legs converge, so that toppling is not a concern, especially with the use of heavy dumbbells. The spaced apart cradles of each stanchion provide hand spaces for a user to freely grasp each dumbbell. The cradles support dumbbells in almost any user desired position, with an especially key element. Each stanchion is free to be positioned ideally for a user, with little chance of collision with bench legs or other equipment, as the first leg of each stanchion is the only stanchion component which extends as far inwardly as the dumbbell cradles. Additionally, the first leg of each stanchion is at least 2 inches longer than the other legs, thereby providing added weight support and also preventing the stanchion from being too near a workout bench. With the first angle member or each stanchion angling backwardly, and the second angle member of each stanchion angled opposite, cantilevered support is provided for quite heavy dumbbells without fear of apparatus failure or toppling. Further, the length of the first angle support is approximately 35 inches. The length of the second angle support is approximately 40 inches. This positions the upright and upright insert a minimum of 28 inches outwardly from a position of the cradled dumbbell. Therefore, most exercises can be performed by a user without stanchion interference. This feature is also key to the apparatus and is a feature not heretofore provided in other devices. Sturdy dumbbell support is further enhanced by placing each x-brace caster at the outer end of each leg of the x-brace.

The stand vertical of each stand is removable, so that stacked weights are easily accessible in stacking or removal. Should a user wish to have the stanchion/s retreat after initial dumbbell lift, the elastomeric cord provided for selective quick connect to each stanchion and each stand is tensioned by rolling stanchion placement so that use of the cord allows retreat of a castered stanchion, once a dumbbell is lifted from the stanchion. Weight of a dumbbell resists the elastomeric cord so that a user positioned stanchion remains so until the dumbbell is lifted. The upright insert of each stanchion provides for multiple height positions of the cradles, with basic pin insertion, thereby allowing a user to hold a dumbbell at virtually any usable height. As each stanchion is independent, no limitations are encountered in dumbbell positioning.

Thus has been broadly outlined the more important features of the improved dumbbell supporting apparatus so that the detailed description thereof that follows may be better understood and in order that the present contribution to the art may be better appreciated.

An object of the dumbbell supporting apparatus is to basic.

Another object of the dumbbell supporting apparatus is to sufficiently sturdy to support virtually any usable dumbbell weight.

A further object of the dumbbell supporting apparatus is to support a dumbbell independently of other equipment.

An added object of the dumbbell supporting apparatus is to provide omnidirectional rolling mobility.

And, an object of the dumbbell supporting apparatus is to provide for dumbbell support beyond the dimensions of each stanchion support.

An added object of the dumbbell supporting apparatus is to provide for stanchion retreat from a user, once a supported dumbbell is lifted.

A further object of the dumbbell supporting apparatus is that a supported dumbbell is held at least 28 inches from the upright and upright insert of the stanchion.

These together with additional objects, features and advantages of the improved dumbbell supporting apparatus will be readily apparent to those of ordinary skill in the art upon reading the following detailed description of presently preferred, but nonetheless illustrative, embodiments of the improved dumbbell supporting apparatus when taken in conjunction with the accompanying drawings.

In this respect, before explaining the current embodiments of the improved dumbbell supporting apparatus in detail, it is to be understood that the dumbbell supporting apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved dumbbell supporting apparatus.

It is therefore important that the claims be regarded as including such equivalent constructions insofar as they do not depart from the spirit and scope of the dumbbell supporting apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the dumbbell supporting apparatus generally designated by the reference number 10 will be described.

Figure 1:
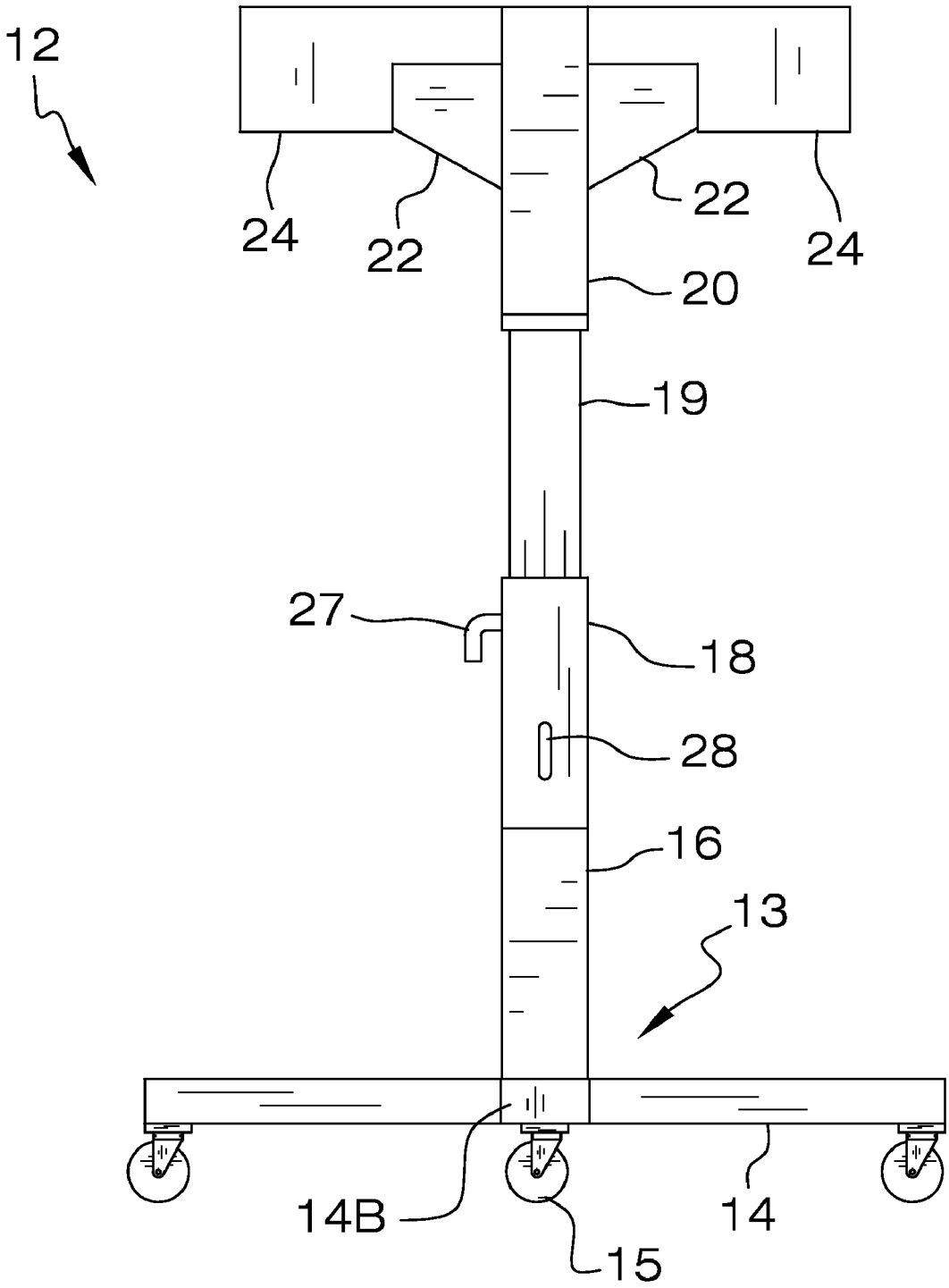
FIG. 1 is a rear elevation view of a stanchion.
Figure 2:
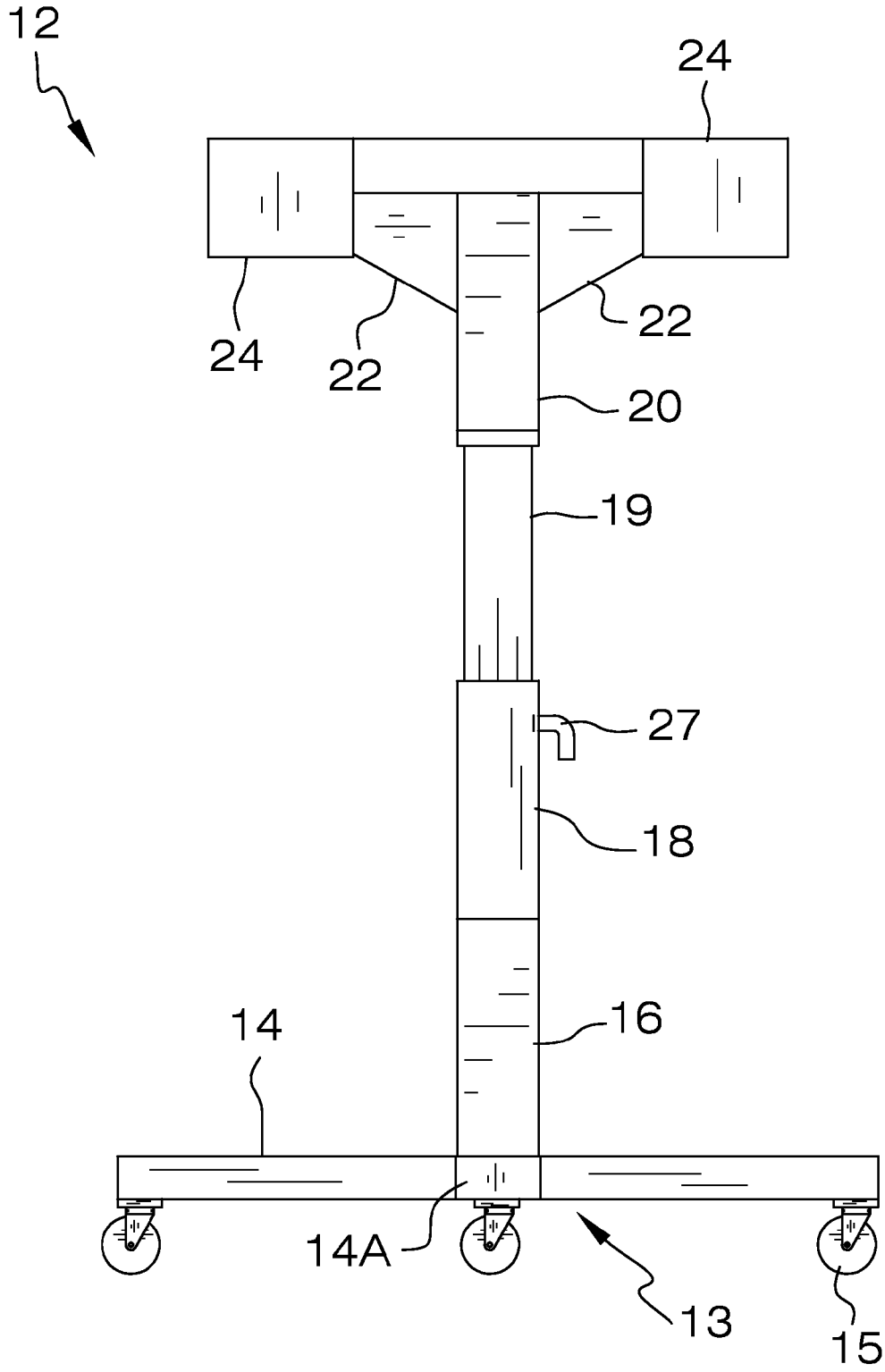
FIG. 2 is a front elevation view of a stanchion.
Figure 3:
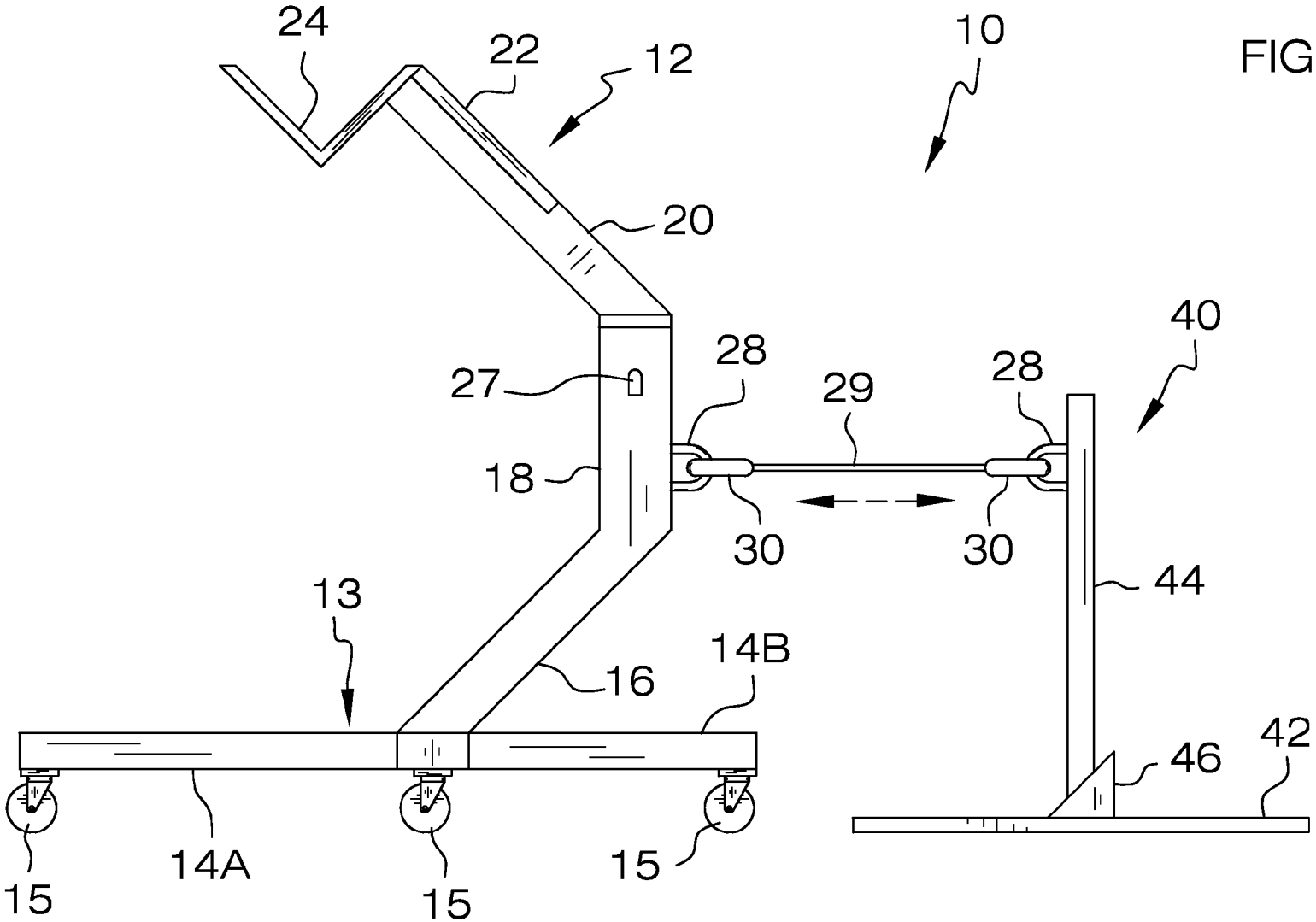
FIG. 3 is a side elevation view of one stanchion and one stand of the apparatus.
Figure 4:
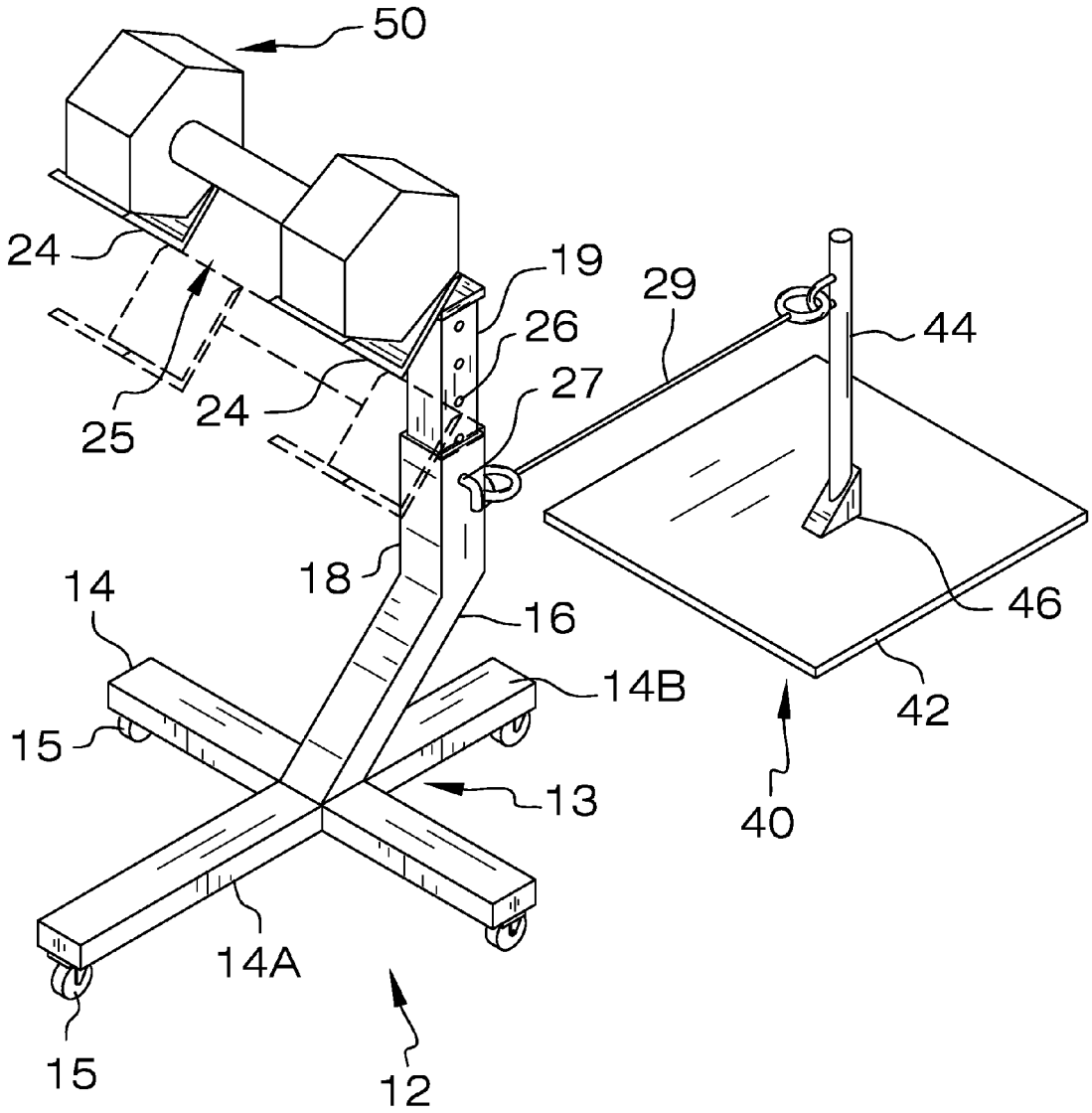
FIG. 4 is a perspective view of a stand and stanchion of the apparatus in use with a dumbbell.

Referring to FIGS. 3 and 4, the dumbbell supporting apparatus 10 is provided in tandem, each stanchion 12 for supporting a dumbbell 50. Each stanchion 12 supports a dumbbell within the spaced apart cradles 24 with the mass of the dumbbell 50 directly above the first leg 14A of the x-brace. The spaced apart cradles 24 provide the cradle gap 25 so that a user's hands are free to grasp the dumbbell 50. The first angle member 16, upright 18, and second angle member 20 provide for a cantilevered support of a dumbbell 50. The cantilevered support of the dumbbell 50 provides that only the cradles 24 can possibly interfere with any user exercises. The stanchion 12 is not in the way of a user's arms when grasping the dumbbell 50, or of dumbbell 50 usage in most positions. Each stanchion 12 is accompanied by an independent stand 40. Each stanchion 12 is selectively attached to one of the stands 40 via an elastomeric cord 29 with quick connects 30 on each end. Therefore, should a stanchion's 12 cradles 24 potentially interfere with any exercise, the stanchion 12 can be elastomerically retreated via the cord 29, once the dumbbell 50 is lifted from the cradles 24.

Referring to FIGS. 1 and 2 and again to 3 and 4, the apparatus 10 comprises, in combination, a pair of stanchions 12. Each stanchion 12 comprises a rolling x-brace support 13. The x-brace support 13 further comprises four spaced apart legs 14. The first leg 14A faces inwardly such that it is positioned below the cradles 24. The second leg 14B faces opposite the first leg 14A. All legs 14 are identical. An omnidirectional caster 15 is disposed on the outward end of each leg 14, thereby providing best support of the stanchion 12 and any dumbbell 50 mass, along with omnidirectional rolling capability of the stanchion 12.

The first angle member 16 is affixed to the center of the x-brace support 13, where all legs 14 converge, the first angle member 16 at about a 45 degree angle. The first angle member 16 is disposed above what is termed the second leg 14B, which is directly opposed to the first leg 14A. The upright 18 is affixed to the upward end of the first angle member 16. The pair of matching holes (not shown) are proximal to the top of the upright 18. Each matching hole is in an opposite side of the upright 18. The upright 18 further comprises a hook 28 on the outward side of the upright 18, above the second leg 14B. The upright insert 19 is slideably fitted within the upright 18. The plurality of equidistantly spaced apart orifices 26 is disposed in the insert 19. The removable pin 27 thereby selectively locates the insert 19 within the upright 18, resulting in a plurality of adjustable heights of the cradles 24 for a user. The second angle member 20 is affixed to the top of the upright insert 19 at about a 45 degree angle. The second angle member 20 angle is opposite that of the first angle member 16 angle. The second angle member 20 is longer than the first angle member 16. The second angle member 20 is disposed partially and directly above the first leg 14A. The cradle support 22 is affixed to the second angle member 20. The pair of spaced apart cradles 24 is affixed to the cradle support 22. The cradles 24 form an upward facing V. The V is ideally suited to hexagonal dumbbells 50, and also functions well with round dumbbells (not shown). The pair of stands 40 is provided, one stand 40 for each stanchion 12. Each stand 40 comprises a rectangular base 42. The anchor 46 is disposed in the approximate center of the base 42. The round stand vertical 44 is slideably inserted into the anchor 46.

The stand vertical 44 is of a size for slideable fit of a weight (not shown) having a central hole. Such weights are most commonly used in weight training. A hook 28 is affixed proximal to the top of the stand vertical 44. A pair of identical elastomeric cords 29 is provided. Each cord 29 has a quick connect 30 on each opposite end. Each cord 29 is for removable connection to the hook 28 of one upright and the hook 28 of one stand vertical 44. The elastomeric tension of each cord 29 is sufficient to draw one rolling stanchion 12 without dumbbell 50 mass toward one stand 40. A user utilizing the cord 29 enables the stanchion's 12 retreat from an area that could potentially interfere with a user's exercise.

With respect to the above description then, it is to be realized that the optimum dimensional relationships for the parts of the dumbbell supporting apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the dumbbell supporting apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the dumbbell supporting apparatus may be used.

Therefore, the foregoing is considered as illustrative only of the principles of the dumbbell supporting apparatus. Further, since numerous modifications and changes will readily occur to those skilled in the art, it is not desired to limit the dumbbell supporting apparatus to the exact construction and operation shown and described, and accordingly, all suitable modifications and equivalents may be resorted to, falling within the scope of the dumbbell supporting apparatus.

What is claimed is:

1. A dumbbell supporting apparatus, comprising, in combination:

a pair of stanchions, each stanchion for the removable support of a dumbbell, each stanchion comprising:

a rolling x-brace support, the x-brace support further comprising four spaced apart legs, a pair of the legs further comprising a first leg facing inwardly, a second leg facing opposite the first leg, the first leg at least 2 inches longer than the other legs;

a caster on each leg;

a first angle member affixed to the support at about a 45 degree angle rearward;

an upright affixed to an upward end of the first angle member;

a hook on an outward side of the upright;

an upright insert slideably fitted within the upright;

means for selectively adjusting the height of the upright insert within the upright;

a second angle member affixed to a top of the upright insert at about a 45 degree angle, the second angle member angle forward and opposite that of the first angle member;

a cradle support affixed to the second angle member;

a pair of spaced apart cradles affixed to the cradle support, the cradles forming an upward facing V, a space between the cradles for free movement of a user's hand;

whereby the dumbbell is removably supported in a cantilevered position at least 28 inches from the upright and upright insert;

a pair of identical stands, each stand comprising:

a base, an anchor in an approximate center of the base;

a round stand vertical slideably inserted into the anchor, the stand vertical of a size for slideable fit of a weight having a central hole;

a hook affixed proximal to a top of the stand vertical;

a pair of identical elastomeric cords, each cord having a quick connect on an each opposite end, each cord for removable connection to the hook of one upright and the hook of one stand vertical, the elastomeric tension of each cord sufficient to draw one stanchion without dumbbell toward one stand.

2. The apparatus according to claim 1 wherein the rolling support further comprises omnidirectional rolling capability.

3. The apparatus according to claim 2 wherein the base further comprises a rectangular shape.

4. The apparatus according to claim 3 wherein the caster on each leg is further disposed proximal to an outer end of each leg.

5. The apparatus according to claim 4 wherein the means for adjusting the height of the upright insert within the upright further comprises a pair of matching holes proximal to a top of the upright, each matching hole in an opposite side of the upright;

a plurality of equidistantly spaced apart orifices in the upright insert, whereby a removable pin selectively locates the insert within the upright.

6. The apparatus according to claim 2 wherein the caster on each leg is further disposed proximal to an outer end of each leg.

7. The apparatus according to claim 6 wherein the means for adjusting the height of the upright insert within the upright further comprises a pair of matching holes proximal to a top of the upright, each matching hole in an opposite side of the upright;

a plurality of equidistantly spaced apart orifices in the upright insert, whereby a removable pin selectively locates the insert within the upright.

8. The apparatus according to claim 1 wherein the base further comprises a rectangular shape.

9. The apparatus according to claim 8 wherein the caster on each leg is further disposed proximal to an outer end of each leg.

10. The apparatus according to claim 9 wherein the means for adjusting the height of the upright insert within the upright further comprises a pair of matching holes proximal to a top of the upright, each matching hole in an opposite side of the upright;

a plurality of equidistantly spaced apart orifices in the upright insert, whereby a removable pin selectively locates the insert within the upright.

11. The apparatus according to claim 1 wherein the caster on each leg is further disposed proximal to an outer end of each leg.

12. A dumbbell supporting apparatus, comprising, in combination:

a pair of stanchions, each stanchion for the removable support of a dumbbell, each stanchion comprising:

a rolling x-brace support, the x-brace support further comprising four spaced apart legs, a first leg facing inwardly, a second leg facing opposite the first leg, a caster on an each outward end of each leg, the first leg at least 2 inches longer than the other legs;

a first angle member affixed to a center of the x-brace support at about a 45 degree angle, the first angle member disposed above the second leg;

an upright affixed to an upward end of the first angle member, a pair of matching holes proximal to a top of the upright, each matching hole in an opposite side of the upright, the upright further comprising a hook on an outward side of the upright;

an upright insert slideably fitted within the upright, a plurality of equidistantly spaced apart orifices in the insert, whereby a removable pin selectively locates the insert within the upright;

a second angle member affixed to a top of the upright insert at about a 45 degree angle, the second angle member angle opposite that of the first angle member angle, the second angle member longer than the first angle member, the second angle member disposed partially and directly above the first leg;

a cradle support affixed to the second angle member;

a pair of spaced apart cradles affixed to the cradle support, the cradles forming an upward facing V, a space between the cradles for free movement of a user's hand;

whereby a mass of the dumbbell is removably supported in a position above the first leg of the x-brace;

a pair of stands, one stand for each stanchion, each stand comprising:

a rectangular base, an anchor in an approximate center of the base;

a round stand vertical slideably inserted into the anchor, the stand vertical of a size for slideable fit of a weight having a central hole;

a hook affixed proximal to a top of the stand vertical;

a pair of identical elastomeric cords, each cord having a quick connect on an each opposite end, each cord for removable connection to the hook of one upright and the hook of one stand vertical, the elastomeric tension of each cord sufficient to draw one stanchion without dumbbell toward one stand.

* * * * *